United States Patent [19]

Tyree, Jr.

[11] 4,045,972

[45] Sept. 6, 1977

[54] $CO_2$ COOLING OF VEHICLES

[76] Inventor: Lewis Tyree, Jr., 145 Briarwood Ave., North, Oak Brook, Ill. 60521

[21] Appl. No.: 708,268

[22] Filed: July 23, 1976

[51] Int. Cl.[2] ..... F25D 21/06

[52] U.S. Cl. ..... 62/156; 62/217; 62/276; 62/514 R; 62/239

[58] Field of Search ..... 62/50-52, 62/80, 81, 217, 156, 276, 282, 514 R, 198, 239

[56] References Cited

U.S. PATENT DOCUMENTS

| | | | |
|---|---|---|---|
| 3,241,329 | 3/1966 | Fritch, Jr. et al. | 62/514 R |
| 3,255,597 | 6/1966 | Carter, Jr. | 62/239 |
| 3,316,726 | 5/1967 | Pauliukonis | 62/239 |
| 3,374,640 | 3/1968 | Boese | 62/514 R |
| 3,421,336 | 1/1969 | Lichtenberger et al. | 62/239 |
| 3,757,531 | 9/1973 | Gement, Jr. | 62/514 R |
| 3,802,212 | 4/1974 | Martin et al. | 62/156 |

*Primary Examiner*—Ronald C. Capossela
*Attorney, Agent, or Firm*—Fitch, Even, Tabin & Luedeka

[57] ABSTRACT

A system for $CO_2$ cooling of the cargo compartment of a refrigerated vehicle. A vessel carried by the vehicle holds liquid $CO_2$ at pressure preferably not greater than about 125 psia. Liquid $CO_2$ is supplied to first heat-exchanger where it is vaporized and warmed a predetermined amount while the pressure is maintained at at least about 80 psia. The pressure of the warmed $CO_2$ vapor is lowered to about atmospheric pressure without the creation of solid $CO_2$, while simultaneously cooling the $CO_2$ vapor, using a gas-driven motor through which the $CO_2$ vapor is passed. The cooled $CO_2$ vapor from the motor is passed through a second heat-exchanger, and a fan connected to the motor circulates the atmosphere in the cargo compartment in association with both heat-exchangers. The $CO_2$ vapor from the second heat-exchanger is vented to the atmosphere exterior of cargo compartment. Isenthalpic expansion means may be used in series with the gas motor, or a second gas motor may be used which can drive a generator to create electric power that is stored in a battery.

13 Claims, 6 Drawing Figures

$CO_2$ COOLING OF VEHICLES

This invention relates to cooling the cargo compartments of refrigerated vehicles, and more particularly to the use of liquid carbon dioxide as a refrigerant for the efficient and economical cooling of the cargo compartments of delivery trucks designed to make a number of stops in a day's time.

Industry has long attempted to utilize an expendable refrigerant, such as liquified nitrogen and liquified or solid carbon dioxide, to provide refrigeration for vehicles, such as railroad cars, trailer trucks, delivery trucks and the like. U.S. Pat. Nos. 3,241,329, 3,255,597, 3,316,726 and 3,561,226, and British Pat. No. 1,119,650 are exemplary of refrigeration systems designed to meet such general needs. Some of these systems result in the creation of an atmosphere within the cargo compartment of the truck which is incapable of supporting human breathing which constitutes a potential hazard.

U.S. Pat. No. 3,802,212 to Martin et al. (Apr. 9. 1974) and U.S. Pat. No. 3,374,640 to Boese (Mar. 26, 1968) more particularly illustrate the use of liquid nitrogen for the cooling of trucks and like vehicles. Although such systems have become commercially practical and generally competitive with mechanical refrigeration systems, which utilize a circulating refrigerant that undergoes compression, condensing and expansion and which have long been used for such purposes, are not without certain disadvantages. The cost of liquid nitrogen keeps increasing relative to liquid carbon dioxide because of the greater amount of electrical power necessary to produce it. However, liquid $CO_2$, at normal storage conditions of 0° F. and 300 psig, is not cold enough for direct substitution in the Boese system when refrigerating foodstuffs, and dry ice snow, if formed, while cold enough will not reliably flow.

It is an object of the present invention to utilize liquid carbon dioxide as an efficient refrigerant for a wheeled vehicle. Another object of the invention is to provide a carbon dioxide refrigeration system for efficiently cooling the cargo compartment of a truck or other vehicle without creating an atmosphere therewithin that is incapable of supporting human life. A still further object of the invention is to provide a system which will efficiently utilize liquid carbon dioxide to create a cold environment while requiring only a minimum of maintenance and relatively low initial capital cost.

These and other objects of the invention will be apparent from the following detailed description of certain preferred embodiments of the invention, when read in conjunction with the accompanying drawings wherein.

The invention in its most efficient form utilizes relatively low pressure (less than about 125 psia) liquid $CO_2$, in combination with heat-exchange means and a gas-driven motor-blower located adjacent the cargo compartment, which cools and circulates the atmosphere therein without flooding the compartment with non-life-supporting carbon dioxide vapor. The system is designed to efficiently extract the cooling capacity from the very cold liquid carbon dioxide under conditions which positively avoid the creation of carbon dioxide snow that could create a blockage within the system and thus seriously deter or halt its refrigeration operation. In the simplest and the preferred configuration, the liquid $CO_2$ in the vehicle storage tank and the liquid supplied to the heat-exchange means are at essentially the same pressure. However, should one wish to employ higher pressure liquid $CO_2$ (above about 125 psia) in the vehicle storage tank, a pressure-reducing valve could be utilized ahead of the heat-exchange means.

Figures 1, 2:
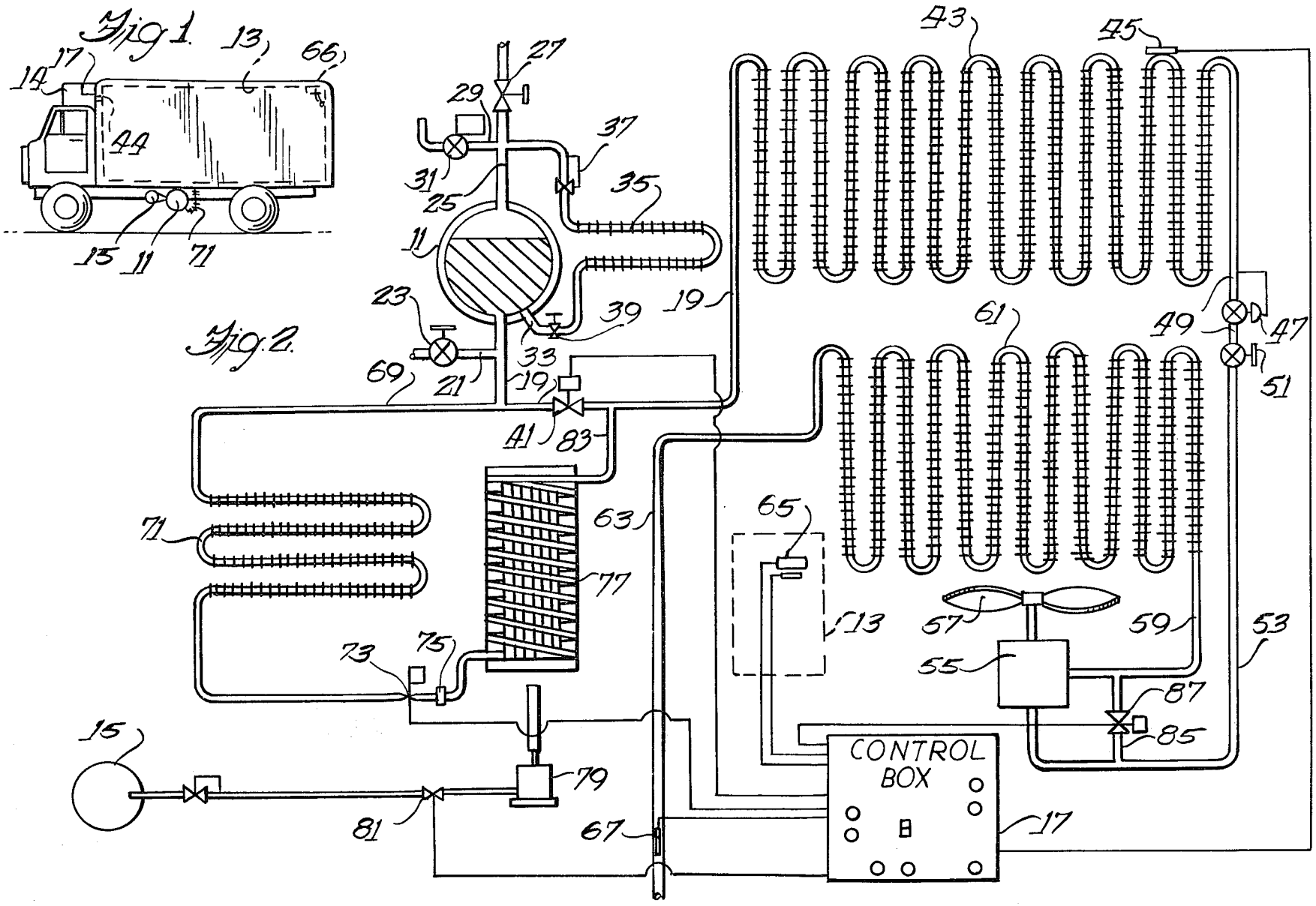
FIG. 1 is a side elevation view of a delivery truck incorporating a carbon dioxide refrigeration system embodying various features of the invention.
FIG. 2 is a schematic view of the carbon dioxide refrigeration system incorporated in the vehicle shown in FIG. 1.

Shown in FIG. 1 is a delivery truck of a type which might be used on a daily delivery route where the driver will have numerous occasions to enter the cargo compartment of the truck and remove refrigerated product at a series of delivery stops. Whereas in many earlier cryogenic systems for vehicles, refrigeration was effected in whole or at least in part by discharging cold $N_2$ or $CO_2$ vapor into the cargo compartment, the present system obviates any such discharge and exhausts the carbon dioxide vapor to the atomsphere exterior of the truck after its refrigeration purpose has been served.

The truck includes an insulated liquid carbon dioxide storage tank or vessel 11, usually located on the underside of the truck, which tank is designed to safely withstand the liquid carbon dioxide pressure, i.e., less than about 125 psia. and usually not greater than about 100 psia. If both the tank 11 and the heat-exchange means operate at the same pressure, than the lower this pressure is, the colder the equilibrium $CO_2$ temperature will be. The colder the temperature of the liquid $CO_2$, the denser the liquid is and the greater will be the available BTU's of cooling per pound. Moreover, colder $CO_2$ temperatures allow better heat transfer across the heat-exchanger means to the cargo compartment atmosphere. The heat-exchange system may be located within the cargo compartment 13 of the truck, for example, at a location near the front wall thereof whereenclosure 14 generally above the cab where it does not detract from valuable storage space. Mounted conveniently near the liquid carbon dioxide storage tank 11 on the underside of the truck is a smaller LPG tank 15, usually containing propane, which is utilized in the defrost cycle of the refrigeration system, as explained in detail hereinafter.

One preferred embodiment of the refrigeration system is shown schematically in FIG. 2. The system is operated by a control system 17 disposed in a box which is usually located exterior of the cargo compartment 13 for easy accessibility, and which is conveniently mounted on the heat-exchanger enclosure 14. The main liquid feed line 19 exits from a lower portion of the liquid $CO_2$ storage tank 11 and is branched at a location close to the tank to provide a fill line 21 which contains a manually operated valve 23. An overhead vapor line 25 is connected to an upper location in the vapor portion of the tank 11 and contains a manually operable valve 27 which can be opened to permit vapor to flow from the tank. During a normal filling operation, both valves 23 and 27 will be open so that the $CO_2$ vapor in the tank 11 which is displaced upon the entry of liquid through the fill valve 23 may be either vented or preferably returned through a suitable ground support system to the main carbon dioxide storage vessel from which the liquid is being supplied.

The vapor line 25 is also branched, and a branch conduit 29 leads to a pressure-reading safety valve 31 which is set to open when the vapor pressure within the tank reaches, for example, within about 5 psi. of the safe tank limit. A small side line 33 is also connected to the lower or liquid portion of the tank 11 and leads to an atmospheric vaporizing coil 35 which is connected through a pressure regulator 37 with the vapor conduit 25 at a location between the tank 11 and the manual valve 27. The vapor pressure in the tank 11 is monitored, and an automatically operable valve 39 in the line 33 is opened to admit liquid $CO_2$ into the ambient vaporizer coil 35 should the tank pressure fall below a desired value, thus serving as a pressure-building circuit. It is important that the pressure of the liquid $CO_2$ in the tank 11 not be allowed to fall below the triple point lest slush be formed which can cause blockage of the liquid lines. As a result, once the tank 11 is appropriately filled with cold, low-pressure liquid carbon dioxide, e.g., 100 psia. and about −58° F., the associated control circuitry and valving will maintain the tank within 3 or 4 psi. of the pressure desired for uniform operation.

A solenoid-controlled feed valve 41 is disposed in the main liquid supply line 19 and is electrically controlled from the circuitry in the control box 17. The liquid feed line 19 continues past the control valve 41 to a first heat-exchanger 43 which is located in the insulated exterior compartment 14 of the vehicle that is connected with the cargo compartment 13 of the vehicle through suitable air passageways 44. The exterior of the heat-exchange coil 43 is provided with an extended heat-exchange surface, for example, transversely or radially extending fins, and its length or capacity is designed so that all of the liquid $CO_2$ being fed to the heat-exchanger will be vaporized in the coil, giving up all its latent heat and a portion of its sensible heat to the air within the scope compartment 13 of the vehicle.

A temperature sensor 45 is located a predetermined distance from the discharge or exit end of the first heat-exchanger 43 (which is generally referred to as the vaporizer). This sensor 45 is connected to the control system 17 and is employed to effect prompt closing of the liquid feed valve 41 should the presence of liquid or excessively cold $CO_2$ vapor be detected near the discharge end of the vaporizer. A pressure-regulator 47 is provided in the vapor line 49 leading from the vaporizer 43 to maintain a minimum pressure, e.g., 80 psia, in the heat-exchange coil 43 and the supply line 19 for the purpose of preventing formation of slush or snow therein. The temperature sensor 45 prevents excessively cold vapor or liquid $CO_2$ from reaching the low pressure side of the back pressure-regulator 47 and the subsequent lines and expansion devices where, during expansion in a valve or in a motor, its tendency would be to form $CO_2$ snow which could result in blockage or at least a reduced level of operation of the refrigeration system. Instead of monitoring the temperature at the discharge end of the heat-exchanger 43, an appropriate downstream temperature sensor could be used, or an intermediate location in the heat-exchanger coil could be monitored for the presence of liquid.

Under intended operating conditions, the $CO_2$ vapor flowing in the line 49 leaving the vaporizer 43 will have been warmed a predetermined, desired number of degrees from the equilibrium temperature at which it was created in the vaporizer. The temperature at which the cargo compartment is being maintained may influence the amount of warming that is effected. The temperature and pressure of this warmed $CO_2$ vapor is then lowered by isenthalpic expansion through a manually adjustable orifice in an expansion valve 51. The refrigeration system may be used to maintain a freezing temperature, i.e., about 5° F., in the cargo compartment 13, or it may be set to maintain a higher temperature, i.e., about 35° F., when freezing the product is to be avoided. Assuming that the liquid pressure in the tank 11 is maintained at about 100 psia. and taking into account the line losses which will occur during travel through the conduit 19 and the vaporizer 43, the expansion orifice 51 may then be adjusted to lower the pressure to about 45 psia. for a system where a temperature of about 5° F. is desirably being maintained in the cargo compartment 13.

From the expansion valve 51, the cooled vapor is directed through a conduit 53 leading to the inlet to a gas motor 55 which is drivingly connected with a blower fan 57. The blower 57 causes the circulation of air throughout the cargo compartment 13 past or in association with the extended exterior surface of the coils of the vaporizer 43. In the gas motor 55, isentropic expansion takes place, resulting in lowering the pressure of the vapor still further, for example, to a point close to atmospheric pressure, and the equilibrium temperature of the vapor is also significantly lowered, e.g., to about −100° F. This cold vapor is then directed through a line 59 leading to a second heat-exchange coil 61 which is also located in the path of the blower fan 57. As a result, the cold $CO_2$ vapor is warmed by absorbing heat from the cargo compartment air, adding its cooling capacity to that of the liquid $CO_2$ being vaporized in the vaporizer 43 and thus effectively and efficiently utilizing the total refrigerant capacity of liquified gas in the storage tank 11. Alternatively, the expansion valve 51 can be switched from line 49 and moved to the line 59 so that the isentropic expansion taken place before the isenthalpic expansion, and a comparable overall result obtained.

As a result of the foregoing arrangement and, in particular, the two-step expansion, either isenthalpic-isentropic or isentropic-isenthalpic, the total coolant capability of the low pressure, liquid $CO_2$ is extracted while avoiding the danger of creating a snow blockage that could disrupt or seriously curtail effective operation. The vapor, after being warmed in the second heat-exchanger 61, is discharged through an exhaust line 63 to the atmosphere at a located exterior of the cargo compartment 13 of the vehicle.

To control the overall operation, a temperature sensor 65 is located at a suitable location in the cargo compartment 13 of the vehicle and is electrically connected to the control box 17. When the temperature sensor 65 reads a temperature above the desired cooling level, the control mechanism 17 causes the supply valve 41 to open, thus feeding liquid $CO_2$ at, for example, approximately 100 psia pressure, to the vaporizer 43, which displaces the vapor already in the vaporizer, forcing it through the back-pressure regulator 47, the expansion orifice 51, and the gas motor 55. As an example of a system set to maintain a temperature of about 0° F. in the cargo compartment, the $CO_2$ vapor passing through the expansion valve 51 is partially expanded to a pressure of about 45 psia and is then expanded to nearly atmospheric pressure in the gas motor 55, lowering the temperature of the $CO_2$ vapor to about $-100°$ F. and driving the fan 57 to circulate the atmosphere throughout the cargo compartment. Operation continues in this manner until the temperature sensor 65 reads a temperature below the lowest temperature desired, at which time the control system 17 shuts the feed valve 41. A switch 66 is preferably provided adjacent the rear doors of the truck which closes the feed valve 41 whenever the doors are opened for the removal of product.

A temperature sensor 67 is also provided in the exhaust conduit 63 for the purpose of detecting frost build-up, and it is likewise connected to the control system 17. Alternatively, if desired, the temperature sensor 67 can be moved upstream of the illustrated location, for example, in the heat-exchange coil 61. Depending upon the humidity of the atmosphere in the cargo compartment 13 of the vehicle, frost may slowly form on the coils of the heat-exchangers 43,61, as in the case of the evaporator section of any refrigeration apparatus. Detection of such a frost build-up can be accomplished by comparing the temperature read by the sensor 67 in the exhaust conduit with the temperature of the atmosphere in the cargo compartment as read by the sensor 65. When this temperature comparison shows that the exiting vapor is at too cold a temperature relative to the temperature of the cargo compartment atmosphere, it is an indication that an insulating layer of frost has built up on the coils which is preventing effective heat-transfer. Upon detection of this condition, the control system 17 automatically shifts into a defrost cycle. Alternatively, the sensor 45 can be employed to not only close the feed valve 41, but to also initiate the defrost cycle.

A branch line 69 connected to the main liquid $CO_2$ supply line 19 leads to an ambient air vaporizer 71 and then through a control valve 73 which is actuated by a solenoid or some suitable device electrically connected to the control system 17. A gas flow control orifice 75 is preferably disposed just downstream of the valve 73 in a conduit leading to a gas heater 77. The heater is associated with a gas burner 79 that is approriately connected to the LPG tank 15 through a remotely operable central valve 81. A hot gas conduit 83 exiting from the heater connects to the main supply line 19 at a location just downstream of the feed control valve 41.

When the control system 17 signals the beginning of the defrost cycle (as by lighting a small lamp on the control box), the main liquid control valve 41 is closed, and the control valve 73 in the line between the ambient vaporizer 71 and the heater 77 is opened. The propane control valve 81 is opened causing the burner 79 to become lit. Liquid carbon dioxide flows slowly through the ambient air vaporizer 71 controlled by the downstream flow-limiting orifice 75 and is vaporized by taking up heat from the atmosphere on the underside of the vehicle, exterior of the cargo compartment 13. The vapor is then warmed to a temperature of approximately 400° F. in the heater 77 and flows through the first heat-exchanger or vaporizer 43 to cause melting of ice that has formed thereupon. Thereafter, the hot $CO_2$ vapor flows through the back pressure control regulator 47, and expansion valve 51 and enters into the line 53 leading to the gas motor 55.

A bypass conduit 85 is provided in parallel with the gas motor 55, and a normally closed valve 87 is installed in the bypass conduit 85. At the beginning of the defrost cycle, the bypass valve 87 is opened and thus short-circuits the gas motor, effectively removing it from the circuit and causing the hot $CO_2$ vapor to flow from the expansion valve directly into the second heat-exchanger 61, through it and finally out the exhaust conduit 63. The high temperature of the $CO_2$ vapor being supplied by the heater 77 results in very rapid melting of any water ice which formed on the exterior surfaces of the vaporizer 43 and the second heat-exchanger 61. The ending of the defrost cycle may be controlled in any suitable manner; for example, a timer can be included in the control box 17 which will limit the flow of $CO_2$ vapor through the valve 73 to a desired time interval. Alternatively, the temperature-monitoring sensor 67 in the exhaust conduit 63 can be used to detect a significant rise in the temperature of the exhaust vapor which will be indicative of the elimination of water ice from the exterior of the coils of the heat-exchangers. Upon completion of the defrost cycle, the control mechanism 17 will again open the liquid supply valve 41 to supply liquid $CO_2$ to the vaporizer 43 as soon as the temperature sensor 65 in the cargo compartment 13 indicates that refrigeration is desired.

Figure 3:
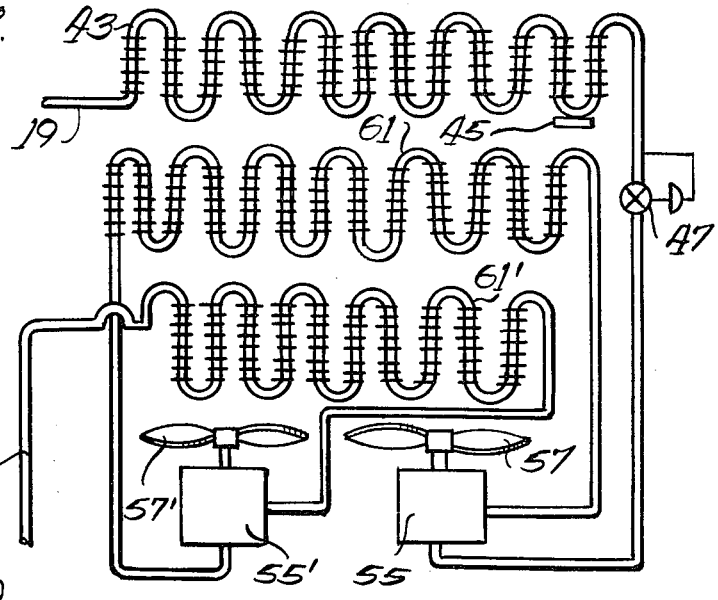
FIG. 3 is a partial schematic view, similar to FIG. 2, of an alternative embodiment of a refrigeration system embodying various features of the invention.

Shown in FIG. 3 is an alternative embodiment of a refrigeration system embodying various features of the invention. Inasmuch as the system utilizes many of the individual components already described with regard to the system depicted in FIG. 2, like reference numerals are used to indicate such components.

In the embodiment illustrated in FIG. 3, the liquid supply system for providing liquid $CO_2$ to the vaporizer 43 is exactly the same as that shown in detail in FIG. 2. The vapor exiting from the vaporizer 43 flows through a back-pressure regulator 47 directly to the entrance to the gas motor 55 (without first being subjected to isenthalpic expansion through an orifice or the like). The gas motor 55 is similarly connected to a blower fan 57 for circulating the cargo compartment air past the vaporizer coils and the coils of the heat-exchanger 61 through which the vapor, which was expanded and cooled in the gas motor, next passes.

The $CO_2$ vapor which was warmed in the heat-exchanger 61 then is directed to the entrance of a second gas motor 55' which is also connected to a blower fan 57' that may be arranged in parallel with the fan 55 to assist it in the circulation of the cargo compartment atmosphere. The $CO_2$ vapor which is re-cooled in the second gas motor 55' is then conducted through still another heat-exchanger 61' and is eventually discharged to the exhaust conduit 63, as in the case of the system shown in FIG. 2. When both blowers are utilized, as shown, to blow the cargo compartment atmosphere in parallel past all three heat-exchanger coils, it is preferably to arrange the heat-exchanger 61' upstream of the heat-exchanger 61, which in turn is upstream of the vaporizer 43. If desired, one of the blowers could be arranged to circulate cargo compartment air only past the vaporizer 43, while the other blower is arranged to blow the atmosphere past the other two heat-exchangers 61 and 61'. Other combinations of heat-exchangers and blowers may also be used; for example, the two blowers could be arranged in series, either adjacent each other or with one in a remote location in the cargo compartment.

The system illustrated in FIG. 3 can be controlled to provide even greater efficiency than that shown in FIG. 2, because the isentropic expansion which is achieved by the usc of the gas motor is more efficient in lowering the temperature of the $CO_2$ vapor than is isenthalpic expansion through an orifice. Additionally, the work accomplished by the gas motors is available not only for cargo compartment air circulation, but also for electric power generation as set forth below. The system is particularly advantageous in cooling the cargo compartment to a temperature of below 35° F. However, the system should be carefully controlled so as to avoid the possibility of snow formation by lowering the temperature of the vapor past the freezing point at a certain pressure. It is for this reason that the heat-exchanger 61 is provided between the two gas motors 55,55' to warm the vapor between the two expansion steps. Moreover, precise control of the individual amount of pressure drop in the first gas motor 55 is accomplished by the careful relative sizing of the two gas motors.

Figure 3A:
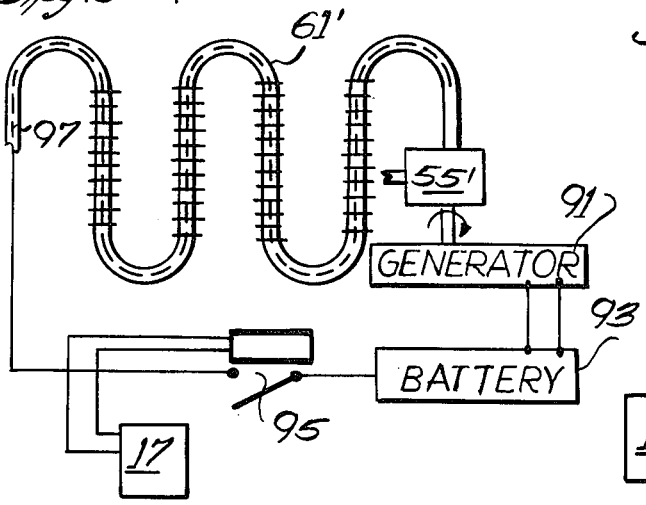
FIGS. 3A and 3B show modified versions of the system illustrated in FIG. 3.

FIG. 3A illustrates a slightly modified version of the refrigeration system depicted in FIG. 3 wherein the second gas motor 55' is used to drive an alternator or generator, hereinafter referred to as generator means 91, instead of a blower — the main blower 57 being relied on for circulation. The alternator is appropriately electrically linked to a battery 93 which will store the electrical power created whenever the feed valve 41 is open and expansion of $CO_2$ vapor is taking place. In this modified version, an electrical defrost arrangement is employed which obviates the need for the propane tank and the associated defrost system depicted in FIG. 2.

When the conditions being monitored indicate that defrosting is necessary, the feed valve 41 is closed, and the control system 17 causes a relay 95 to close which applies electrical power to a resistance heater 97 that is associated with the heat-exchange coil 61'. Although only one coil is shown, it should be understood that a resistance heater will be associated with each of the heat-exchange coils and appropriately linked to the battery 93 via the relay 95. Sufficient electrical heating to assure defrosting is then carried out, usually for a predetermined time interval. The control system 17 then opens the relay 95, and the refrigeration system again functions normally to supply liquid $CO_2$ to the vaporizer 43 if the temperature in the cargo compartment 13 is above the desired level.

Figure 3B:
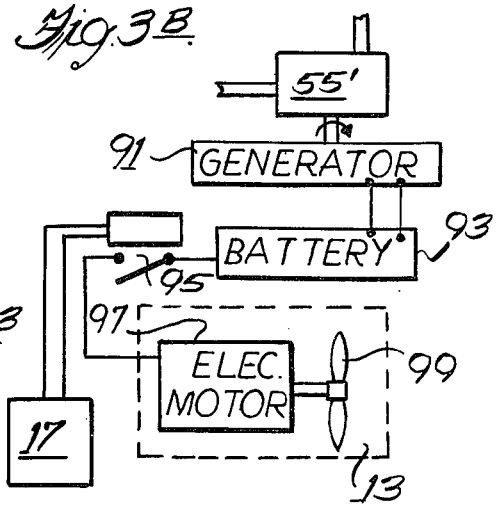

FIG. 3B discloses still another modification wherein an alternator or generator 91, connected to the second gas motor 55', is suitably linked to a power-storing electrical battery 93. However, instead of using the battery power for defrosting purposes, an electric motor 97 and blower 99 are provided in a location in the cargo compartment 13 remote from the main blower system, which as illustrated may be adjacent the front wall of the truck compartment. The electric motor 97 is connected to the battery 93 via the relay 95 which is linked to the control system 17.

In this version, whenever the feed valve 41 is closed so that the main blower 57 is not being driven by the gas motor 55, the control system 17 closes the relay 95 applying power to the electric motor 97 which drives the blower 99 and thus creates a circulation of the cargo compartment air while the refrigeration system is "at rest", thus assuring a more uniform temperature throughout the entire cargo compartment. The truck door switch 66 would of course be connected in the control circuitry to open the relay 95 and remove power from the remote electric motor 97 whenever the delivery doors are open. The modified system takes further advantage of the available work which can be gained by using an additional gas motor and results in a more efficient overall arrangement.

Figure 4:
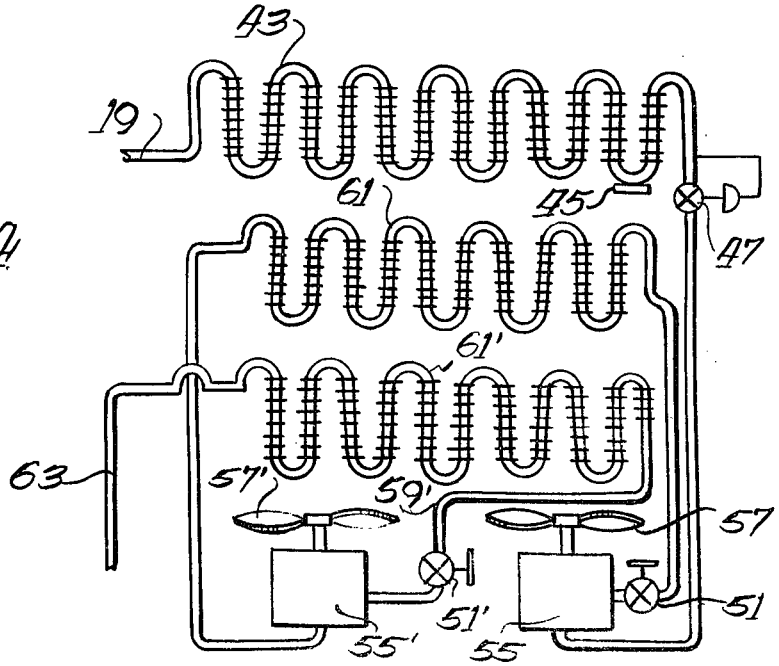
FIG. 4 is a partial schematic view, similar to FIG. 3, of still another alternative refrigeration system embodying various features of the invention.

Illustrated in FIG. 4 is still another alternative embodiment of a refrigeration system embodying various features of the invention which can also have greater efficiency than that depicted in FIG. 2. The system depicted in FIG. 4 combines the features of the systems described with respect to FIGS. 2 and 3, and it can be particularly advantageous when it is desired to achieve a cargo compartment temperature of about −20° F.

Again using similar reference numerals, the liquid carbon dioxide being supplied is vaporized in a first heat-exchanger or vaporizer 43 and then passes through the back pressure regulator 47 and then to gas motor 55. The partially expanded vapor exiting from the gas motor 55 is then directed to the manually adjustable expansion orifice 51 which has been place in the line 59 leading to the heat-exchanger 61. The gas motor 55 and the expansion valve 51 are sized so that the temperatue drop of the vapor expanding therein as limited so that carbon dioxide snow is not created.

The warmed $CO_2$ vapor from the heat-exchanger 61 is then again partially expanded through a second gas motor 55', which is in turn connected to a blower fan 57'. The fan 57' may be located to circulate air in parallel with the blower fan 57 as described with respect to the FIG. 3 embodiment, or it may be arranged otherwise as discussed previously.

The $CO_2$ vapor from the second gas motor 55' is directed to a second expansion valve 51' in the line 59' and is then caused to flow through the heat-exchanger 61' before it is finally discharged into the exhaust conduit 63, as in the case of the FIG. 3 embodiment. By lowering the pressure of the high pressure carbon dioxide vapor in steps separated by an intermediate warming step, a greater quantum of refrigeration can be extracted therefrom, with much less potential likelihood of the creation of carbon dioxide snow, should slight operating fluctuations occur in the system. As mentioned before, the four-step expansion process allows for greater control and renders the system particularly advantageous when it is desired to maintain a temperature of about −20° F. in a cargo compartment.

It should also be understood that one or more additional gas motors, in association with heat-exchange means, may be substituted for one or more of the expansion valves shown in FIG. 4. Such gas motors take further advantage of the work available in the vapor, and they could be used to create and store electric energy as depicted in FIGS. 3A and 3B.

Although the invention has been described with respect to certain preferred embodiments, it should be understood that various changes and modifications as would be obvious to one having the ordinary skill in the refrigeration art may be made without deviating from the scope of the invention, which is defined solely by the claims appended hereto. Various of the features of the invention are set forth in the claims which follow.

What is claimed is:

1. A system for cooling the cargo compartment of a refrigerated vehicle using $CO_2$, which system comprises a vessel carried by the vehicle for holding liquid $CO_2$, means for filling said vessel with liquid $CO_2$, first heat-exchanger means for vaporizing said liquid $CO_2$ and warming said $CO_2$ vapor, conduit means for supplying liquid $CO_2$ from said vessel to said first heat-exchanger means, means for lowering the pressure of said warmed $CO_2$ vapor to about atmospheric pressure without the creation of solid $CO_2$ and simultaneously cooling said $CO_2$ vapor, which pressure-lowering means includes a gas-driven motor through which said $CO_2$ vapor is passed, pressure-regulation means for maintaining a minimum vapor pressure of at least about 80 psia between said first heat-exchange means and said pressure-lowering means, fan means connected to said motor for circulating the atmosphere in said cargo compartment in association with said first heat-exchange means, second heat-exchange means connected to the discharge from said pressure-lowering means for receiving said cooled $CO_2$ vapor therefrom, and means for exhausting said $CO_2$ vapor which exits from said second heat-exchange means to the atmosphere exterior of said cargo compartment.

2. A system in accordance with claim 1 wherein said pressure-lowering means also includes isenthalpic expansion means.

3. A system in accordance with claim 1 wherein said pressure-lowering means also includes a second gas-motor for creating rotary power and further heat-exchange means connected to receive said $CO_2$ vapor downstream of its passage through said second gas-motor.

4. A system in accordance with claim 3 wherein said pressure-lowering means further includes isenthalpic expansion means in series with said first gas-motor at a location between said first heat-exchange means and said second heat-exchanger means.

5. A system in accordance with claim 3 wherein generator means is provided which is drivingly connected to said second gas-motor, wherein battery means is provided which is electrically connected to said generator means for storing electric power created by said generator means, wherein electrical heating means is provided for defrosting said further heat-exchanger means, and wherein means is provided for automatically electrically interconnecting said battery and said heating means when defrosting is desired.

6. A system in accordance with claim 3 wherein generator means is provided which is drivingly connected to said second gas-motor, wherein battery means is provided which is electrically connected to said generator means for storing electric power created by said generator means, wherein an electric motor and blower are povided for circulating the air in said cargo compartment, and wherein means is provided for electrically interconnecting said battery sand said motor when liquid $CO_2$ is not being supplied to said first heat-exchanger means.

7. A system in accordance with claim 1 wherein sensing means is provided in association with said first heat-exchange means and wherein means is connected to said sensing means for halting supply of liquid $CO_2$ to said first heat-exchange means as long as said sensing means senses a condition indicative that insufficient warming of said $CO_2$ vapor is occurring in said first heat-exchange means.

8. A system in accordance with claim 1 wherein said conduit means supplies liquid $CO_2$ to said first heat-exchange means at a pressure not greater than about 125 psia.

9. A method for cooling the cargo compartment of a refrigerated vehicle using $CO_2$, which method comprises filling a vessel carried by the vehicle with liquid $CO_2$, supplying the liquid $CO_2$ from the vessel to first heat-exchange means, vaporizing said liquid $CO_2$ supplied and warming said vapor at least a predetermined amount in the first heat-exchange means, maintaining a vapor pressure of at least about 80 psia in the first heat-exchange means, lowering the pressure of said warmed $CO_2$ vapor in increments to about atmospheric pressure without the creation of solid $CO_2$, siad pressure-lowering including the step of driving a gas-motor connected to fan means for circulating the cargo compartment atmosphere in association with the first heat-exchange means, passing said lower pressure $CO_2$ vapor through second heat-exchange means to warm said vapor and exhausting said warmed $CO_2$ vapor to the atmosphere exterior of the cargo compartment following its passage through the second heat-exchange means.

10. A system in accordance with claim 9 wherein said liquid $CO_2$ is supplied to the first heat-exchange means at a pressure of not greater than about 125 psia.

11. A system in accordance with claim 10 wherein said pressure-lowering also includes isenthalpic expansion.

12. A system in accordance with claim 9 wherein said pressure-lowering includes driving a second gas-motor connected to second fan means and warming said $CO_2$ vapor to further heat-exchange means downstream of its passage through sais second gas-motor, said second fan means directing the cargo compartment atmosphre past the further heat-exchange means.

13. A method in accordance with claim 12 wherein said pressure-lowering further includes isenthalpic expansion of said vapor prior to said warming in the second heat-exchange means.

* * * * *

UNITED STATES PATENT AND TRADEMARK OFFICE

CERTIFICATE OF CORRECTION

PATENT NO. : 4,045,972

DATED : September 6, 1977

INVENTOR(S) : Lewis Tyree, Jr.

It is certified that error appears in the above-identified patent and that said Letters Patent are hereby corrected as shown below:

Column 2, line 47, "reenclosure" should read --re it would be furthest removed from the rear entry doors; however, it is often located, as illustrated, exterior of the truck in an elevated location in an insulated enclosure--.
Column 3, line 42, "scope" should be --cargo--.
Column 4, line 12, after "freezing", insert --of--.
Column 4, line 42, "taken" should be --takes--.
Column 4, line 53, "located" should be --location--.
Column 6, line 54, "preferably" should be --preferable--.
Column 9, line 55, "sand" should be --and--.
Column 10, line 29, "siad" should be --said--.
Column 10, lines 38, 41 and 44, "system" should be --method--,
Column 10, line 47, "to" should be --in--,
Column 10, line 48, "sais" should be --said--,
Column 10, lines 49-50, "atmosphre" should be --atmosphere--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*